United States Patent [19]

Cazzaro et al.

[11] 4,226,824

[45] Oct. 7, 1980

[54] PROCESS FOR SPINNING MODACRYLIC FIBER HAVING HIGH RETRACTION AND REDUCED INFLAMMABILITY

[75] Inventors: Giorgio Cazzaro, Saronno; Domenico Malgeri, Magenta; Giancarlo Matera, Monza; Antonino Cavallaro, Cesano Maderno, all of Italy

[73] Assignee: Societa Nazionale Industria Applicazioni Viscosa S.p.A., Italy

[21] Appl. No.: 905,032

[22] Filed: May 9, 1978

[30] Foreign Application Priority Data

May 13, 1977 [IT] Italy ..... 23504 A/77

[51] Int. Cl.[3] ..... D01F 6/18

[52] U.S. Cl. ..... 264/182; 264/210.7; 525/201; 525/212; 525/230; 526/187; 526/240

[58] Field of Search ..... 264/182, 210.7; 525/201, 212, 230; 526/240, 187

[56] References Cited

U.S. PATENT DOCUMENTS

| | | | |
|---|---|---|---|
| 3,052,512 | 9/1962 | Kocay et al. | 264/210 F |
| 3,384,694 | 5/1968 | Nakayama et al. | 264/182 |
| 3,404,204 | 10/1968 | Nakagawa et al. | 264/182 |

FOREIGN PATENT DOCUMENTS

| | | | |
|---|---|---|---|
| 40-22008 | 9/1965 | Japan | 264/182 |
| 42-6013 | 3/1967 | Japan | 264/182 |
| 42-19509 | 10/1967 | Japan | 264/182 |
| 42-22589 | 11/1967 | Japan | 264/182 |
| 45-12537 | 5/1970 | Japan | 264/182 |
| 51-40429 | 4/1976 | Japan | 264/182 |

*Primary Examiner*—Jay H. Woo

*Attorney, Agent, or Firm*—Wenderoth, Lind & Ponack

[57] ABSTRACT

Modacrylic fibers having high retraction, reduced inflammability and high glossiness, prepared by wet spinning a solution, in an organic spinning solvent miscible with water, of a mixture of copolymers from acrylonitrile, vinylidene chloride, at least a vinyl ester and at least an unsaturated monomer containing at least a sulphonic group, the acrylonitrile units being from 50% to 85% by weight and the vinyl ester units from 3% to 6% by weight; hot drawing the coagulated fiber in a mixture of water and spinning solvent; drying the fiber in hot air while leaving it free concurrently to contract; and subsequently further hot drawing it in air.

13 Claims, No Drawings

PROCESS FOR SPINNING MODACRYLIC FIBER HAVING HIGH RETRACTION AND REDUCED INFLAMMABILITY

BACKGROUND OF THE INVENTION (1) The Field of the Invention

The invention refers to modacrylic fibres, viz. fibres consisting of copolymers of acrylonitrile with other comonomers copolymerizable therewith and wherein acrylonitrile is present in amounts from 50 to 85% inclusive, possessed of reduced inflammability, high gloss and high retraction, and to a process for their manufacture.

(2) The Prior Art

According to the standards of this art, fibers having a retraction of at least 35%, measured under the conditions hereinafter to be specified, are considered to be high retraction fibers.

Fibers of said type are desirable in particular for the manufacture of synthetic furs. Said manufacture requires the use of high retraction fibers also having adequate mechanical properties and a good glossiness; it is further highly desirable for this particular application that the fibre should have a reduced inflammability.

The problem of obtaining such fibers has not found a complete and satisfactory solution in the art up to now. As far as the Applicant knows, no modacrylic fiber having reduced inflammability and high retraction, suitable for the production of imitation furs, exists on the market.

Actually methods are known for producing high inflammability, high retraction modacrylic type fibers, but they involve manufacturing processes that are significantly more complicated than those employed for standard acrylic fibers. A process of this kind is described, e.g., in British Pat. No. 998,990, which describes the preparation of fibres from binary copolymers of acrylonitrile and, e.g. vinyl acetate, and mentions the possibility of making ternary copolymers of acrylonitrile, a vinylpyridine or vinylimidazole, and methacrylonitrile or vinyl chloride, or further, to use mixtures of binary interpolymers. In any case the said polymers do not have reduced inflammability, since to be considered as reduced inflammability fibers, the fibers must have a LOI index of at least 26.

In order to obtain a high retraction, a rather complicated process is adopted in said patent, which comprises the following steps:

(1) After coagulation, the fibers undergo a reduced stretch, to a draw ratio from 1.5 to 2.5 (instead of the 5–6 draw ratios which are customary for standard acrylic fibers) in a boiling water bath and a subsequent washing and a finishing with suitable antistatic and lubricating agents;

(2) After the finishing, the fibers are dried on calendering rolls internally heated to 120° C.;

(3) The fibers are caused to contract freely by treatment with saturated steam at a pressure from 35 to 55 psi;

(4) After contraction, the fibers undergo a second stretch to draw ratios from 1.3 to 3, in a water bath kept between 70° and 95° C.;

(5) The fibers are then cooled while being maintained under sufficient tension to prevent them from shrinking; and (6) The fibers are subjected to a second drying effected under tension by means of air at a temperature below 70° C.

It is obvious that this is a rather complicated discontinuous treatment which requires extremely long times and therefore very large and expensive driers, since the final drying has to take place at rather low temperatures. Therefore the treatment considerably raises the production cost of the fiber.

The known art does not disclose any simpler systems for producing high retraction acrylic and modacrylic fibers, and the making of such fibers with low inflammability is not even considered in the known processes, at least not with respect to LOI index values of at least 26.

It is clear that it would be highly desirable to provide a process for the preparation of a copolymer adapted for the manufacture of fibers possessed of high retraction, reduced inflammability, high gloss, and adequate mechanical characteristics, simple enough to be carried out in the installations generally used for the manufacture of standard acrylic and modacrylic fibers.

SUMMARY OF THE INVENTION

The Applicant has solved the aforesaid problem by providing a process by means of which fibers having high retraction and reduced inflammability and all the desired characteristics are obtained through operations which may be carried out in normal installations for the production of acrylic or modacrylic fibers and which operations are therefore greatly simplified in comparison to those known for similar purposes.

The invention is based on a combination of prescriptions as to composition and process which are set forth hereinafter.

According to the invention, the spinning dope from which the fibers are spun is constituted by a solution in an organic spinning solvent miscible with water—which is preferably dimethylformamide (hereinafter indicated as DMF) but may also be another solvent such as dimethylacetamide or dimethylsulphoxide—of a mixture of copolymers deriving from acrylonitrile, a vinyl ester preferably selected from methyl acrylate, vinyl acetate and methyl methacrylate, and at least an unsaturated monomer containing at least a sulphonic group, wherein the units deriving from acrylonitrile are present in an amount from 50 to 85% by weight and those deriving from the vinyl ester in an amount from 3 to 6% by weight. After coagulation the coagulated fiber is drawn in hot water or a mixture of water and the spinning solvent, to a draw ratio from 1.5 to 4.5; subsequently it is subjected to drying with hot air at temperatures from 100° to 130° C. while it is allowed concurrently to contract; and subsequently it is subjected to a further hot drawing in air at a temperature from 50° to 100° C. to a draw ratio from 1.5 to 3.5. Further, preferably, the monomer containing at least a sulphonic group is selected from monomers which homopolymerize at a concentration of $2\times10^{-1}$ mols per liter, in DMF containing 6 mols/liter of water, in the presence of $2\times10^{-3}$ mols per liter of azoisobutyronitrile, at a temperature of 67° C., attaining after 11 hours a conversion rate of at least 35%. Sulphonic monomers which meet said condition will be called "significantly homopolymerizable" and this expression, as used in the claims, is to be understood as signifying that the monomer homopolymerizes under the conditions and with the conversion rate specified hereinbefore. The sulphonic monomers hitherto used in the art for making the products to which the invention refers, are not "significantly homopolymerizable", and do not provide, or provide to a markedly lower degree, the desirable properties which this invention provides.

Still preferably, the following conditions are complied with:

(a) The drawing in water is effected at a temperature from 80° to 100° C.

(b) The drying in air is effected at temperatures between 110° and 120° C.

(c) The hot drawing in air is effected at temperatures between 70° and 80° C.

The temperatures suitable for the drawing in water are chosen high enough not to cause filament breakages. Generally a draw ratio of 1.5 can already be readed at about 30°-40° C., while higher ratios require higher temperature, up to the boiling temperature. The most suitable temperatures are comprised between the boiling point and the temperatures which are calculated for each draw ratio from the following formula: $t=15.X+17.5$, wherein "X" is the draw ratio.

Preferably the said copolymer mixture is present in the solution in overall amounts which vary from 20 to 30% by weight of the total weight of the solution and as a whole it contains monomeric units in the following weight percentages with respect to the total weight of the copolymers: acrylonitrile from 50 to 85%; vinylidene chloride from 10.5 to 40.5%; monomer containing at least a sulphonic group from 1.5 to 3.5%; and units deriving from the vinyl ester from 3 to 6%.

The spinning dope is prepared by using one or the other of the following two methods:

(a) two copolymers are separately prepared, preferably by copolymerization in the spinning solvent, which have the following preferred compositions: the first, a binary copolymer, is constituted by acrylonitrile and the monomer containing at least a sulphonic group, and in it, the acrylonitrile content varies from 63 to 92% by weight and the sulphonic monomer content varies from 37 to 8% by weight; and the other is a ternary copolymer constituted by acrylonitrile, vinylidene chloride and vinyl ester, wherein the acrylonitrile content is from 32 to 76% by weight, the vinylidene chloride content from 20 to 57% by weight, and the vinyl ester content from 4 to 11% by weight; and the solutions of the two copolymers in the same spinning solvent are mixed in such proportions that the resulting copolymer mixture will have the following preferred composition by weight: units deriving from acrylonitrile from 50 to 85%, units deriving from vinylidene chloride from 10.5 to 40.5%, units deriving from the monomer containing at least a sulphonic group from 1.5 to 3.5% and units deriving from the vinyl ester from 3 to 6%; or optionally (b) the binary copolymer is prepared as indicated at (a) by a first copolymerization in solution in the spinning solvent, the resulting solution (A) is added to a solution (B) of the comonomers of the ternary copolymer hereinbefore defined, and the whole is subjected to a second copolymerization, the amount of solution (A) added being such that the resulting final polymeric material will have the following preferred composition by weight: units deriving from acrylonitrile from 50 to 85% units deriving from vinylidene chloride from 10.5 to 40.5%, units deriving from the monomer containing at least a sulphonic group from 1.5 to 3.5%, and units deriving from the vinyl ester from 3 to 6%.

After the extrusion of the spinning dope obtained in one or the other of the aforesaid ways, and the coagulation thereof in a bath constituted by a mixture of water and the organic spinning solvent, the coagulated fibre is drawn at draw ratios preferably comprised between 2 and 4 in water or mixtures water/solvent at the temperatures specified hereinbefore, and is subsequently subjected to drying with hot air at the temperatures specified hereinbefore while it is allowed concurrently to shrink by an amount of about 25-30%, whereafter the fiber is subjected to a further hot drawing in air at the temperatures specified hereinbefore to a draw ratio preferably from 1.5 and 3.

The copolymeric composition obtained according to the invention permits one to obtain a fiber which is already free from voids at the moment of its coagulation and which maintains said structure during all the spinning phases so that a glossy fiber is obtained which has all the required properties: a result which could not be achieved by the previously known techniques.

In the present description the word "copolymer" is to be understood, unless otherwise specified, as applying to any polymeric product in the formation of which more than one monomer has participated.

Preferably the monomer containing at least a sulphonic group employed is a sait (preferably an alkali or ammonium salt) of an acid having the general formula (1).

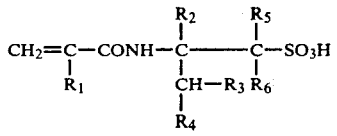

(1)

wherein $R_1$ represents a hydrogen atom or a short chain alkyl radical, and $R_2$, $R_3$, $R_4$, $R_5$, $R_6$, equal or different from one another, represent a hydrogen atom or an alkyl, cycloalkyl or aryl radical.

The preferred acid having the general formula (1) is 2-acrylamido-2-methylpropanesulphonic acid.

The fiber obtained by the process hereinbefore defined has good glossiness, retraction above 35%, and dynamometric characteristics suitable for making synthetic furs.

Objects of the invention are the aforesaid process, the fibre which derives therefrom, the compositions of matter constituted by the spinnable viscous dopes which are obtained by the methods described, as well as the spinning process described, which is essentially a three-stage process without discontinuities instead of a discontinuous six-stage process like that of the prior art, and, what is even more important, does not comprise any low temperature stage requiring a prolonged treatment and therefore large apparatus. The said process therefore may be carried out in the already existing installations for manufacturing modacrylic fibers or for manufacturing standard acrylic fibers without introducing other stages and/or apparatus.

PREFERRED EMBODIMENTS

The following examples are illustrative but not limitative. In said examples the various binary, ternary and quaternary copolymers according to the present invention are obtained from copolymerization carried out in homogeneous phase in a solvent in suitably equipped reactors; the respective fibers have been obtained, as described hereinafter, by using as the coagulating bath a mixture of solvent (DMF) and water and by producing a count of 0.25 tex per filament. The processing conditions in Examples 1 to 4 are:

(α) Drawing in water at 80° C., to draw ratio equal to 2, of the fibre coagulated in a bath containing 40% by weight of DMF and 60% by weight of water at 15° C.;

(β) Drying in air at 110°-120° C. with free contraction to an amount of 25-30%;

(γ) Hot drawing in air at 70°-80° C. to draw ratio equal to 2.

Examples 5 and 6 are carried out under different conditions, as will be specified. However the examples may be repeated with satisfactory results by varying in any desired degree the treatment parameters within the limits hereinbefore specified for each one of them. In particular it should be noted that the draw ratios for the drawing in air, which, as has been stated, may vary from 1.5 to 3.5, may be obtained at higher or lower temperatures, but above 100° C. the characteristics of the fibre may deteriorate due to an undesirable setting thereof, while below 50° C. excessive and unacceptable filament breakages appear.

The fibers obtained are then subjected to the following control tests which illustrate the characteristics of the fibre which may be obtained according to the present invention:

(a) RETRACTION

The retraction of the fiber is measured by the percentage contraction which the fiber undergoes when kept in an air oven for 20 min at the temperature of 140° C. under free shrinkage conditions. The contraction is measured on 2 inches long fiber test samples which are blocked at their ends by two clamps mounted on a suitable frame, one of said clamps being fixed and the other free to slide in such a way as not to interfere with the contraction of the fibre.

The contraction of the fibers which are the object of the present invention should be at least 35%.

(b) DEGREE OF GLOSS

The degree of gloss is determined by using a photogoniometer type Zeiss GP2 in which a ray of light is directed on to the fibre at an angle of incidence of 45°. The incident light ray produces a reflected light ray likewise forming an angle of 45° with the surface which the incident light ray strikes, as well as light diffused in an average direction perpendicular to said surface.

This method affords an instrumental measure of the degree of gloss which agrees to the highest possible extent with the eyesight perception, and which is expressed as the Luster index (Ls), defined by the following formula in which:

$R_R$=intensity of reflected light
$R_d$=intensity of diffused light
$R_I$=intensity of incident light $$Ls = \frac{R_R - R_d}{R_R} \cdot 100$$

The Luster Ls index acquires the value 100 in the case of a perfectly reflecting surface wherein $R_R=R_I$ and $R_d=0$ and the value 0 in the case of a perfectly diffusing surface wherein $R_R=R_d$, both being less than $R_I$.

(c) DEGREE OF INFLAMMABILITY

The degree of inflammability is measured the LOI index (Limiting Oxygen Index), which is determined according to the ASTM-D2863-70 method.

Products having a LOI index of at least 26 are to be considered as having reduced inflammability.

(d) DYNAMOMETRIC CHARACTERISTICS

The dynamometric characteristics which are determined are:

(1) Filament count in tex
(2) Tenacity in g/tex
(3) Elongation at break in percentages

EXAMPLE 1

In this example the conditions are set forth relative to the preparation of the two copolymers, binary and ternary, according to the method for making the spinning dope, indicated under (a) hereinbefore, which copolymers, combined in the ratio of 20 parts of the first to 80 parts of the second, furnish a flame resistant, glossy fiber which has a contraction percentage, under the previously illustrated conditions, higher than the minimum 35% required.

The binary copolymer is obtained by copolymerizing, at 67° C. for 11 hours, 27.2 parts by weight of acrylonitrile, 4.8 parts by weight of 2-acryamido-2-methylpropanesodium sulphonate (hereinafter called "sulphonic derivative") in 2 parts of water and 66 parts of dimethylformamide, in the presence of 0.027 parts by weight of azoisobutyronitrile and 0.015 parts by weight of a stabilizer (malic acid), obtaining, after distillation of the unreacted volatile monomers, a solution containing 22.5% of polymer. The ternary copolymer is obtained by copolymerizing, at 51° C. for 13 hours, 22.54 parts by weight of acrylonitrile, 20.70 parts by weight of vinylidene chloride and 2.76 parts by weight of methyl methacrylate in 6 parts by weight of water and 48 parts by weight of dimethylformamide, in the presence of 0.2 parts by weight of azoisobutyronitrile and 0.1 parts by weight of zinc paratoluenesulphonate, obtaining, after distillation of the unreacted volatile monomers, a solution containing 22.5% of polymer. 80 parts by weight of the solution of the ternary copolymer thus obtained are mixed, in a static or dynamic mixer of the kind usually employed for high viscosity polymeric solutions, with 20 parts by weight of the solution of the binary copolymer previously obtained. The fiber obtained by spinning said polymer mixture has the following composition by weight: 56.2% of units from acrylonitrile, 36% of units from vinylidene chloride, 4.8% of units from methyl acrylate, and 3% of units from the sulphonic derivative.

The fiber thus obtained, subjected to the thermomechanical treatment in the way specified hereinbefore, gives the following control data:

retraction: 40%
degree of gloss: 77%
degree of inflammability (LOI): 26
dynamometric characteristics:
count: 0.24 tex
tenacity: 17 g/tex
elongation: 24%

The control data evidence a retraction markedly higher that the required 35% minimum, a good glossiness, and an inflammability and textile characteristics adequate for use in the manufacture of imitation furs.

EXAMPLE 2

In this example the control data are given relative to a fibre having the same final composition as that of Example 1 but obtained by the method for the preparation of the spinning dope hereinafter indicated under (b).

The copolymerization mixture of the binary copolymer is obtained in the same way as indicated in Example 1. One part by weight of said mixture, taken immediately after the copolymerization without distilling the unreacted volatile monomers, is added to 6.5 parts by weight of mixture containing 23.85 parts by weight of acrylonitrile, 19.55 parts by weight of vinylidene chloride, 2.6 parts by weight of methyl acrylate, 6 parts by weight of water and 48 parts by weight of dimethylformamide.

The resulting mixture is subjected to copolymerization at 52° for 13 hours in the presence of 0.2 parts by weight of azoisobutyronitrile and 0.1 part of weight of zinc paratoluenesulphonate.

At the end of the copolymerization, the copolymer produced had the following composition by weight:

56.2% of units deriving from acrylonitrile
36% of units deriving from vinylidene chloride
4.8% of units deriving from methyl acrylate
3% of units deriving from the sulphonic derivative The spinning dope containing said copolymer, obtained after distillation of the unreacted volatile monomers, which are recovered, is spun in the same way as indicated in Example 1 and subjected to thermo-mechanical treatment in the way specified hereinbefore, whereby a fiber is obtained having the following characteristics:

retraction: 41%
degree of gloss: 75%
degree of inflammability (LOI): 26
dynamometric characteristics:
filament count: 0.24 tex
tenacity: 18 g/tex
elongation: 25%

Comparing the above control data with those relative to Example 1, it is seen that there is practically no difference between the two fibers.

EXAMPLE 3

In this example the control data are given relative to a fibre obtained by operating under the same conditions and in the same way as in Example 1, reducing however the quantity of methyl acrylate in the copolymerization from 2.76 to 1.75 parts by weight. 20 parts by weight of a 21.5% solution of a binary copolymer obtained by copolymerizing 4.8 parts by weight of the sulphonic derivative and 27.2 parts by weight of acrylonitrile, are mixed with 80 parts by weight of a 21.5% solution of a ternary copolymer prepared by copolymerizing 23.55 parts by weight of acrylonitrile, 20.70 parts by weight of vinylidene chloride, and 1.75 parts by weight of methyl acrylate.

The final fiber, obtained by spinning the mixture of said binary with said ternary copolymer, is constituted by: 57.8% by weight of units deriving from acrylonitrile, 36% by weight of units deriving from vinylidene chloride, 3.2% by weight of units deriving from methyl acrylate, and 3% by weight of units deriving from the sulphonic derivative. Said fiber, subjected to the thermo-mechanical treatment in the way specified hereinbefore, has the following control data:

retraction: 35%
degree of gloss: 77%
degree of inflammability (LOI): 26
dynamometric characteristics:
filament count: 0.24 tex
tenacity: 19 g/tex
elongation: 22%

From the control data it appears that in comparison to the fibres of Examples 1 and 2, the retraction is down to the 35% limit below which the fiber is no longer acceptable, whereas the dynamometric characteristics are slightly improved.

EXAMPLE 4

In this example the control data are given relative to a fiber obtained by operating under the same conditions and in the same way as in Example 1, but increasing the quantity of methyl acrylate in the copolymerization from 2.76 to 3.30 parts by weight. 20 parts by weight of a 23.5% solution of a binary copolymer prepared by copolymerizing 4.8 parts of sulphonic derivative and 27.2 parts by weight of acrylonitrile, are mixed with 80 parts by weight of a 23.5% solution of a ternary copolymer obtained by copolymerizing 22.00 parts by weight of acrylonitrile, 20.70 parts by weight of vinylidene chloride and 3.30 parts by weight of methyl acrylate.

The fiber resulting from the spinning of this copolymer mixture has the following composition:

55% by weight of units deriving from acrylonitrile
36% by weight of units deriving from vinylidene chloride;
6% by weight of units deriving from methyl acrylate; and
3% by weight of units deriving from the sulphonic derivative.

Said fiber has the following control data:

retraction: 50%
degree of gloss: 76%
degree of inflammability (LOI): 26
dynamometric characteristics:
filament count: 0.25 tex
tenacity: 16 g/tex
elongation: 35%

From the control data, it appears that in comparison to the preceding examples, the fiber has a higher retraction with textile characteristics that are still sufficient for the specific use contemplated.

EXAMPLE 5

In this example the control data are given of a fiber obtained under the same conditions as the fiber of Example 4, with the only difference that after coagulation the fiber has been drawn in water at 85° C. to a draw ratio of 4.5.

Control data:

retraction: 47%
degree of gloss: 76%
degree of inflammability (LOI): 26
dynamometric characteristics:
filament count: 0.25 tex
tenacity: 22 g/tex
elongation: 21%

EXAMPLE 6

In this example the control data are given of a fiber obtained under the same conditions as in Example 4, with the only difference that after coagulation, the fiber has been drawn in water at 40° C. with draw ratio 1.5.

Control data:

retraction: 52%
degree of gloss: 72%
degree of inflammability (LOI): 26 dynamometric characteristics:

filament count: 0.24 tex
tenacity: 14 g/tex
elongation: 38%

EXAMPLE 7

In this example, which does not illustrate the invention but serves for purposes of comparison, the control data are given of a fiber obtained by operating in the same way as in Example 1, but excluding the presence of methyl acrylate. 20 parts of a 22.5% solution of a binary copolymer prepared by copolymerizing 4.8 parts by weight of sulphonic derivative and 27.2 parts by weight of acrylonitrile, are mixed with 80 parts by weight of a 22.5% solution of a binary copolymer obtained by copolymerizing 25.3 parts by weight of acrylonitrile and 20.70 parts by weight of vinylidene chloride.

The fiber obtained by spinning, under the same conditions as in the foregoing examples, the solution of said copolymer mixture, had the following composition by weight: 61% by weight of units deriving from acrylonitrile; 36% by weight of units deriving from vinylidene chloride; and 3% by weight of units deriving from the sulphonic derivative.

Said fiber has given the following control data:

retraction: 25%
degree of gloss: 77%
degree of inflammability (LOI): 26 dynamometric characteristics:

filament count: 0.24 tex
tenacity: 22 g/tex
elongation: 30%

It is evident that the fiber has insufficient retraction and inadequate textile characteristics.

We claim:

1. Process for the manufacture of modacrylic fibers having a retraction of above 35%, reduced inflammability and high glossiness, comprising the steps of:

(a) preparing a viscous spinning dope constituted by a solution, in an organic spinning solvent miscible with water, of a mixture of copolymers deriving from acrylonitrile, vinylidene chloride, at least a vinyl ester and at least an unsaturated monomer containing at least a sulphonic group, wherein the units deriving from acrylonitrile are present in an amount from 50% to 85% by weight and those derived from the vinyl ester in an amount from 3% to 6% by weight; spinning said dope in a coagulating bath constituted by a mixture of water and spinning solvent;

(b) drawing the coagulated fiber at a draw ratio from 2 to 4 in a liquid selected from the group consisting of water and mixtures of water and spinning solvent at a temperature of from 80° to 100°;

(c) subsequently drying the fiber by means of hot air at temperatures from 100° and 130° C. while leaving it free concurrently to contract to a degree of about 25% to 30%; and (d) subsequently subjecting the fiber to a further hot drawing in air at a draw ratio from 1.5 to 3.5 at a temperature from 50° to 100° C.

2. Process according to claim 1, wherein the drawing in the liquid selected from the group consisting of water and mixtures of water and spinning solvent, is effected at temperatures in the range from the boiling temperature to the temperature calculated from the formula $t=15.X+17.5$, wherein "X" is the draw ratio.

3. Process according to claim 1, wherein the hot drawing in air is effected at temperatures from 70° to 80° C.

4. Process according to claim 1, wherein a significantly homopolymerizable comonomer, is used as said monomer containing at least a sulphonic group.

5. Process according to claim 4, wherein the significantly homopolymerizable monomer is selected from the group consisting of alkali and ammonium salts of acrylamido-alkylsulphonic acids having the general formula

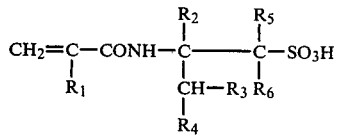

wherein $R_1$ represents a hydrogen atom or a short chain alkyl radical, and $R_2$, $R_3$, $R_4$, $R_5$, $R_6$, equal to or different from one another, represent a hydrogen atom or an alkyl, cycloalkyl or aryl radical.

6. Process according to claim 5, wherein the salt of the acrylamido-alkylsulphonic acid is a salt selected from the group consisting of alkali and ammonium salts of 2-acrylamido-2-methylpropanesulphonic acid.

7. Process according to claim 1, wherein the vinyl ester is selected from the group consisting of methyl acrylate, methyl methacrylate and vinyl acetate.

8. Process according to claim 1, wherein the copolymer mixture contained in the spinning dope has the following composition by weight: units deriving from acrylonitrile from 50% to 85%; units deriving from vinyl ester from 3% to 6% units deriving from vinylidene chloride from 10.5% to 40.5% units deriving from the monomer containing at least a sulphonic group from 1.5% to 3%.

9. Process according to claim 1, wherein the spinning solvent is selected from the group consisting of dimethylformamide, dimethylacetamide, and dimethylsulphoxide, and the coagulating bath is a mixture of water and the spinning solvent.

10. Process according to claim 1, wherein the viscous spinning dope is prepared by mixing two solutions, in the same solvent, of two copolymers, the one a binary copolymer obtained by the copolymerization of acrylonitrile with the monomer containing at least one sulphonic group, and the other a ternary copolymer obtained by the copolymerization of acrylonitrile, vinylidene chloride and vinyl ester.

11. Process according to claim 10, wherein the binary copolymer is obtained by copolymerizing from 63% to 92% by weight of acrylonitrile with 37% to 8% by weight of at least one monomer containing at least one sulphonic group; the ternary copolymer is obtained by copolymerizing from 32% to 76% by weight of acrylonitrile, from 20% to 57% by weight of vinylidene chloride and from 4% to 11% by weight of vinyl ester; and the solutions of the binary copolymer and of the ternary copolymer in the same spinning solvent thus obtained are mixed in such proportions that the resulting copolymer will have the following composition by weight: units deriving from vinylidene chloride from 10.5% to 40.5%, units deriving from the monomer containing at least a sulphonic monomer from 1.5% to 3.5%, and units deriving from the vinyl ester from 3% to 6%.

12. Process according to claim 1, wherein said viscous spinning dope is obtained by firstly copolymerizing in the spinning solvent acrylonitrile and a monomer containing at least a sulphonic group, by subsequently mixing the resultant copolymerized product in solution with a second solution of acrylonitrile, vinylidene chloride and vinyl ester in monomeric form in the same solvent, and by finally subjecting the mixture thus obtained to polymerization.

13. Process according to claim 12, wherein the binary copolymer is obtained by copolymerizing from 63% to 92% by weight of acrylonitrile with from 37% to 8% by weight of at least one monomer containing at least a sulphonic group, and adding said solution (A) containing the resulting copolymer to a second solution (B) containing from 32% to 76% by weight of acrylonitrile, from 20% to 57% by weight of vinylidene chloride, and from 4% to 11% by weight of vinyl ester, and thereafter subjecting the whole to polymerization; the amount of solution (A) added being such that the resulting final copolymer will have the following composition by weight: units deriving from acrylonitrile from 50% to 85%; units deriving from vinylidene chloride from 10.5% to 40.5%; units deriving from the monomer containing at least a sulphonic group from 1.5% to 3.5% and units deriving from the vinyl ester from 3% to 6%.

* * * * *

UNITED STATES PATENT AND TRADEMARK OFFICE

CERTIFICATE OF CORRECTION

PATENT NO. : 4,226,824

DATED : October 7, 1980

INVENTOR(S) : Giorgio Cazzaro et al.

It is certified that error appears in the above—identified patent and that said Letters Patent is hereby corrected as shown below:

On the Title page, Item [73] "Societe Nazionale Industria Applicazioni Viscosa S.p.A." should read --- SNIA Viscosa Societa Nazionale Industria Applicazioni Viscosa S.p.A. ---.

Signed and Sealed this

*Third* Day of *November 1981*

[SEAL]

*Attest:*

GERALD J. MOSSINGHOFF

*Attesting Officer*

*Commissioner of Patents and Trademarks*